US008641324B2

(12) United States Patent
Quash et al.

(10) Patent No.: US 8,641,324 B2
(45) Date of Patent: Feb. 4, 2014

(54) OIL TRANSPORT PIPES

(75) Inventors: John Quash, Grimsby (GB); Paul Lawrence, Grimsby (GB); Ali Reza Kambiez Zandiyel, Grimsby (GB)

(73) Assignee: Dunlop Oil & Marine Limited, Pyewipe Grimsby (GB)

( * ) Notice: Subject to any disclaimer, the term of this patent is extended or adjusted under 35 U.S.C. 154(b) by 576 days.

(21) Appl. No.: 11/579,983

(22) PCT Filed: Dec. 20, 2004

(86) PCT No.: PCT/GB2004/005436

§ 371 (c)(1),
(2), (4) Date: May 15, 2008

(87) PCT Pub. No.: WO2005/108200

PCT Pub. Date: Nov. 17, 2005

(65) Prior Publication Data

US 2008/0233818 A1 Sep. 25, 2008

(30) Foreign Application Priority Data

May 8, 2004 (GB) ..... 0410319.8

(51) Int. Cl.
*F16L 1/00* (2006.01)

(52) U.S. Cl.
USPC ..... 405/168.1; 405/158

(58) Field of Classification Search
USPC ..... 405/158, 168.1, 168.2, 171, 210; 441/1, 441/3, 4, 21, 23; 166/350, 367
See application file for complete search history.

(56) References Cited

U.S. PATENT DOCUMENTS

| | | | | |
|---|---|---|---|---|
| 3,651,525 | A | 3/1972 | Rutten et al. | |
| 4,145,909 | A * | 3/1979 | Daughtry | 405/168.1 |
| 4,263,004 | A | 4/1981 | Joubert et al. | |
| 4,342,519 | A * | 8/1982 | Botrel et al. | 405/169 |
| 5,480,264 | A | 1/1996 | Hunter | |
| 5,749,676 | A * | 5/1998 | Head | 405/171 |
| 5,984,585 | A * | 11/1999 | Pallini et al. | 405/223.1 |
| 6,109,989 | A | 8/2000 | Kelm et al. | |
| 6,558,215 | B1 | 5/2003 | Boatman | |

(Continued)

FOREIGN PATENT DOCUMENTS

| | | |
|---|---|---|
| FR | 2397084 | 2/1979 |
| FR | 2808263 | 11/2001 |

(Continued)

OTHER PUBLICATIONS

Written Opinion of the International Searching Authority, PCT/GB2004/005436, Nov. 23, 2006, Dunlop Oil & Marine Limited et al.
European Search Report, Aug. 9, 2004, EPO.

*Primary Examiner* — Benjamin Fiorello
(74) *Attorney, Agent, or Firm* — McDonald Hopkins, LLC

(57) ABSTRACT

Apparatus for transferring oil between a first facility and a second facility. The apparatus comprises a pipe supported at one end by a floating buoy and decoupling arrangement to decouple movement of the buoy from a substantial portion of the pipe. The decoupling arrangement is generally arranged to support a portion of the pipe adjacent the floating buoy and may comprise, for example, a tether attached to the floating buoy, one or more diverter disks attached onto the length of pipe, a sliding connection or an arrangement of weights and buoys along the length of the pipe.

3 Claims, 8 Drawing Sheets

(56) References Cited

U.S. PATENT DOCUMENTS

| | | | | |
|---|---|---|---|---|
| 2003/0091396 | A1* | 5/2003 | Barras et al. | 405/158 |
| 2003/0224674 | A1* | 12/2003 | Perera et al. | 441/4 |
| 2004/0077234 | A1* | 4/2004 | Lavagna et al. | 441/4 |
| 2005/0196242 | A1* | 9/2005 | Masetti et al. | 405/158 |

FOREIGN PATENT DOCUMENTS

| | | |
|---|---|---|
| GB | 2309576 | 3/1997 |
| GB | 2387635 | 10/2003 |
| NL | 8701849 | 3/1989 |
| WO | WO02/060750 | 8/2002 |

* cited by examiner

OIL TRANSPORT PIPES

This is a U.S. National Stage Application of International Patent Application Ser. No. PCT/GB2004/005436 filed Dec. 20, 2004, which claims priority to Great Britain. Provisional Patent Application No. 0410319.8 filed on May 8, 2004.

The present invention relates to transport pipes for use in the production, storage or offloading of oil, and in particular to the transport of oil to a floating buoy.

Various types of floating system are known in the oil industry, any of which may be connected to an export pipe. These are usually designed to be moored 'on station' in the same place for long periods of time. The floating systems take many forms. For example a Floating Storage and Offloading system (FSO) has tanks for the storage of oil, and a method of loading the oil into offtake shuttle tankers. They do not have oil production or processing facilities. Floating Production Storage and Offloading systems (FPSO) have facilities for receiving crude oil from producing wells and processing for export in addition to the storage and offloading facilities. In appearance, an FPSO is similar to a ship or a tanker. A Floating Production System (FPS) can be any module for receiving crude oil from a well and processing it. It does not necessarily have storage facilities, in which case it has export pipes leading to shore or an FSO. A Floating Storage Unit (FSU) only stores oil. Export pipes may be provided leading to shore or to shuttle tankers—similar to FSOs. Other floating systems are also known, and include any floating offloading unit to which oil is transferred, and which is in communication with an FSO, FPSO, FPS, FSU etc.

Floating systems having export pipes leading to shore or to shuttle tankers are known. If the export pipe is allowed to run along the seabed, high ambient pressure and the extra length of pipe required increase the likelihood of damage to the pipe. If a surface floating pipe system is adopted, weather damage becomes a problem. Surface floating pipes are also unacceptable due to the navigation problems they cause. For example, a tanker section of an FPSO may require at least 300 m of clear water in every direction around a point at which it is moored. This is because it is usual for the tanker section to be 'freely' moored allowing it to move around the mooring point to minimise the effects of any severe weather conditions.

In many cases, the floating system is linked by a pipe to a floating buoy. A tanker can then moor itself to the buoy, a safer option than mooring directly to the floating system. It is a problem that the floating buoy is exposed to severe weather conditions, moving up and down in the water. It is known to moor the buoy with chains or cables to the seabed to restrict the movement of the buoy. However, this arrangement involves the use of several chains or cables and is therefore not a particularly practical arrangement.

Known export pipes are generally made up of either long lengths of continuous flexible hose, or homogeneous titanium or steel. Where large amounts of oil need to be transferred it is usually required to have a number of strings running in parallel. These can be large diameter flexible pipes in short sections, e.g. of the order of 10 m, which can be used to form a long string or continuous hoses or steel pipes. It is a problem with many hose types that compression and tension forces acting on the pipe cause undesirable stress and ultimately result in wear and tear reducing the useful life of the pipe.

Accordingly the present invention provides apparatus for transferring oil between a first facility and a second facility, the apparatus comprising a pipe supported at one end by a floating buoy and decoupling means arranged to decouple movement of the floating buoy from a substantial portion of the pipe wherein the decoupling means is arranged to support a portion of the pipe adjacent the floating buoy and comprises a tether extending between the floating buoy and a supported point of the pipe.

The tether may comprise a resilient tether, preferably a nylon tether. The length of the tether may be less than the length of the pipe between the floating buoy and the supported point, preferably between 45 m and 180 m. The supported length of the pipe, comprising the distance between the floating buoy and the supported point, may be between 70 m and 280 m.

The decoupling means may alternatively, or additionally, comprise a load and buoy arrangement wherein a buoy is provided at a first position along the pipe and a load is provided at a second position along the pipe between the first position and the floating buoy.

The net buoyancy of the buoy may be between 5 te and 80 te and the submerged weight of the load may be between 2.4 te and 38.4 te.

The first position may be between 40 m and 685 m from the floating buoy and the second position may be between 20 m and 345 m from the floating buoy.

Preferably the net buoyancy of the buoy is about 40 te, the submerged weight of the load is about 19 te, the first position is about 340 m from the floating buoy and the second position is about 170 m from the floating buoy.

The pipe may be subjected to bending forced in the region of the buoy and so protective means may be provided. Drag means may also be provided for controlling the degree of bending of the pipe. The drag means may comprise one or more drag plates, which may be inclined at an angle of between 30° and 330° relative to the pipe. Preferably the, or each drag plate is inclined at an angle of about 45° or 315° relative to the pipe. The, or each drag plate has an axial drag area of between 0.5 $m^2$ to 7.5 $m^2$ and may comprise a generally circular drag plate.

Preferably the drag means is provided on the pipe adjacent the floating buoy.

The decoupling means may also comprise a sliding joint comprising two halves, one half connected to a first pipe length and the other half connected to a second pipe length, the two halves being moveably connected to each other in a direction longitudinal to the pipe.

The sliding joint may be either in a locked state or a sliding state. Alternatively, the sliding joint may be either in a locked state, a sliding state or in a transition state between the locked and sliding states.

Downward movement of the floating buoy causes the two halves of the sliding joint to slide in relation to each other. Upward movement of the floating buoy causes the two halves of the sliding joint to lock in relation to each other. This helps to decouple the movement of the floating buoy from a substantial section of the pipe.

Shaping means may also be provided, arranged to hold the pipe in a predetermined geometrical configuration, such as a W shape.

The shaping means may comprise buoying means which may be located at or adjacent the centre of the W shape. The buoying means may comprise a buoyed section. The pipe may comprise a plurality of segments wherein the buoying means comprises buoyed segments.

The total length of the pipe may be between 3000 m and 1500 m and preferably between 2560 m and 1780 m. Preferably the pipe length is either about 1.1 times the distance between the facilities or about 1.38 times the distance between the FPSO and the SPM.

The length of the buoyed section of the pipe may comprise between 15% and 40%, preferably about 30%, of the total length of the pipe.

The internal diameter of the pipe is preferably about 16 inches (40 cm) but may be between 16 inches and 30 inches (40 cm and 75 cm).

The geometrical configuration may be undulating or substantially sinusoidal. The pipe may comprise a plurality of spaced apart buoyed sections to form this geometric configuration. The buoyed sections are generally evenly spaced apart along the length of the pipe and may be located at or adjacent peaks of the undulating or sinusoidal configuration. The buoyed sections may comprise buoyed segments.

The total length of the pipe may be between 3000 m and 1500 m and is preferably between 2560 m and 1780 m.

Using this geometric configuration, the length of the buoyed sections may comprise between 20% and 50% of the total length of the pipe.

One or more buoys may be provided at predetermined discreet positions along the pipe. The, or each, buoy may have a mass of between 16 te and 43 te and a volume of between 41 $m^3$ and 106 $m^3$. The net buoyancy may be between 26 te and 66 te and the, or each, buoy has a drag area of between 10 $m^2$ and 21 $m^2$.

In one arrangement, two buoys may be positioned along the pipe. The distance between the floating buoy and the buoy closest to the floating buoy may be less than the distance between the two buoys. The distance between the offloading unit and the buoy closest to the offloading unit may be between 200 m and 1100 m.

The buoy(s) may be evenly distributed between the floating buoy and offloading unit along the length of the pipe or alternatively may be irregularly distributed between the floating buoy and the offloading unit along the length of the pipe. The length of the pipe may be between 1.2 and 1.62 times the distance between the FPSO and the SPM.

Protective means may be provided for protecting the pipe against bending forces.

It will be understood that this invention may be applied to systems using flexible hoses or equally to steel pipes. The first facility may refer to an FPSO or to a facility on the seabed.

Preferred embodiments of the present invention will now be described by way of example only with reference to the accompanying drawings in which.

Figure 8A:
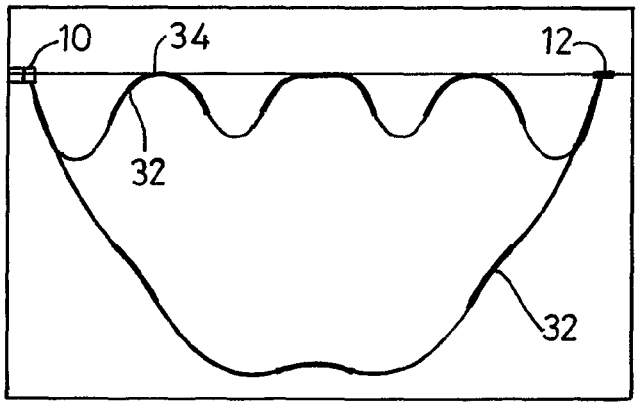

FIG. 8*a* shows the configurations with maximum and minimum buoyancy ratios.

Figure 6:
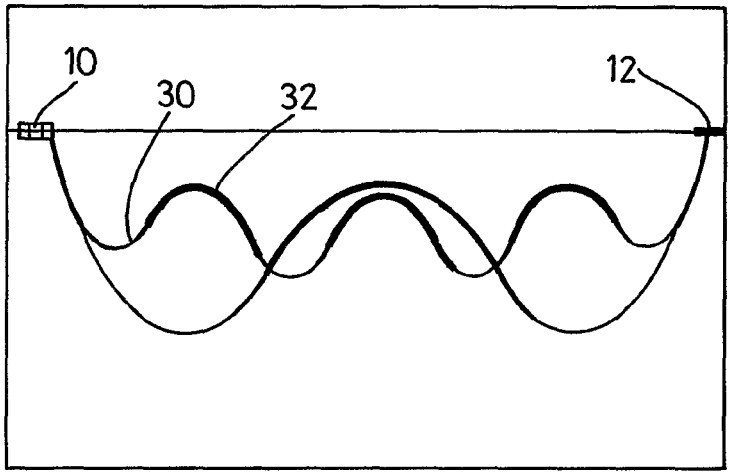
FIG. 6 shows the configuration with a plurality of buoyed regions.
Figure 8B:
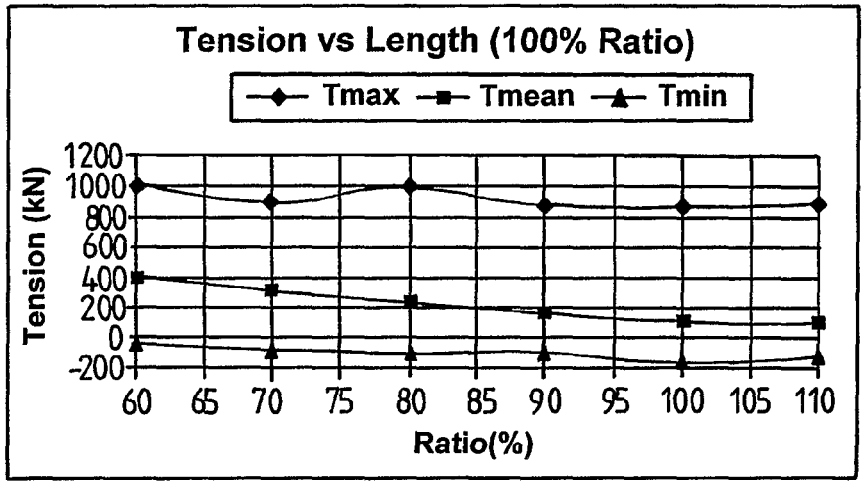

FIG. 8*b* is a plot of the tension variation due to buoyancy variation in the configuration shown in FIG. 6.

Figure 9:
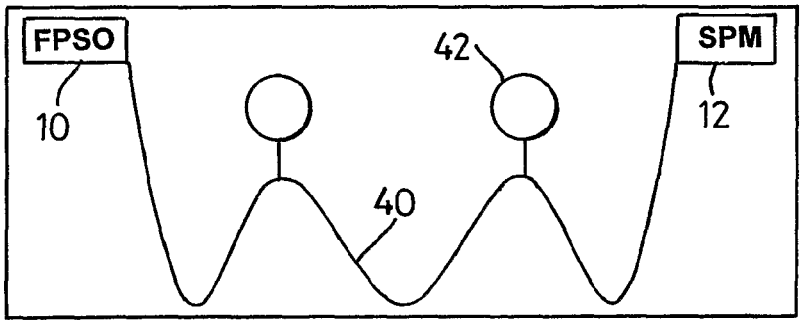

FIG. 9 shows the configuration using two large buoys.

Figure 10:
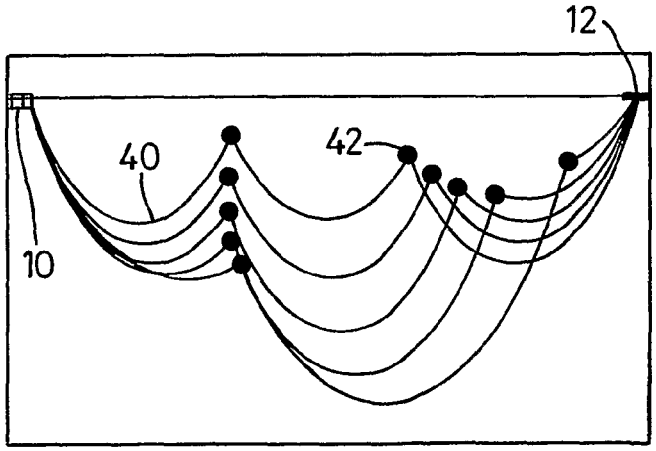

FIG. 10 shows the configuration variation for buoy offset variation.

Figure 11:
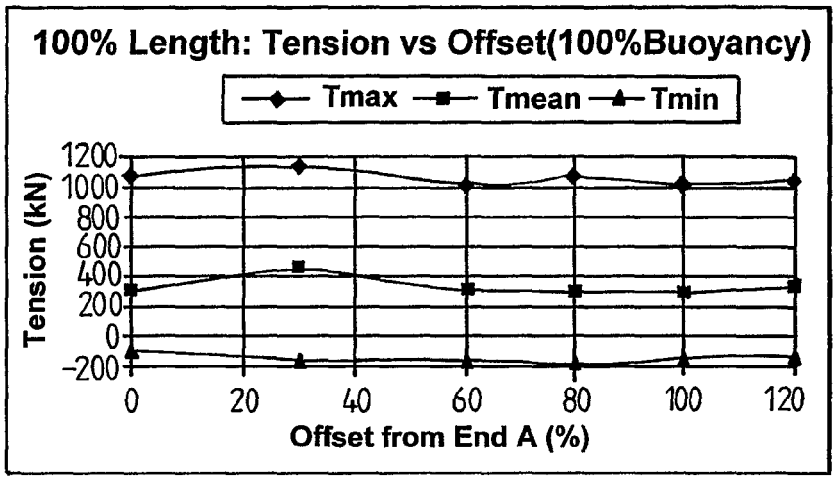

FIG. 11 is a plot of the tension variation due to buoy offset variation for 100% length.

Figure 11A:
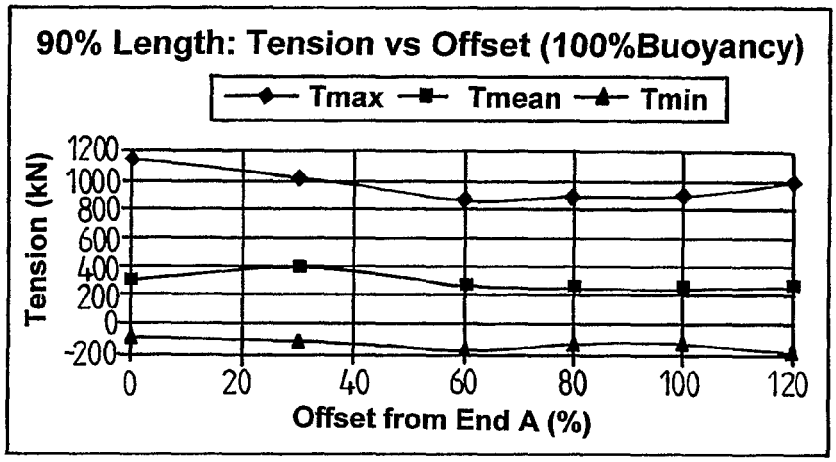

FIG. 11*a* is a plot of the tension variation due to buoy offset variation for 90% length.

Figure 12:
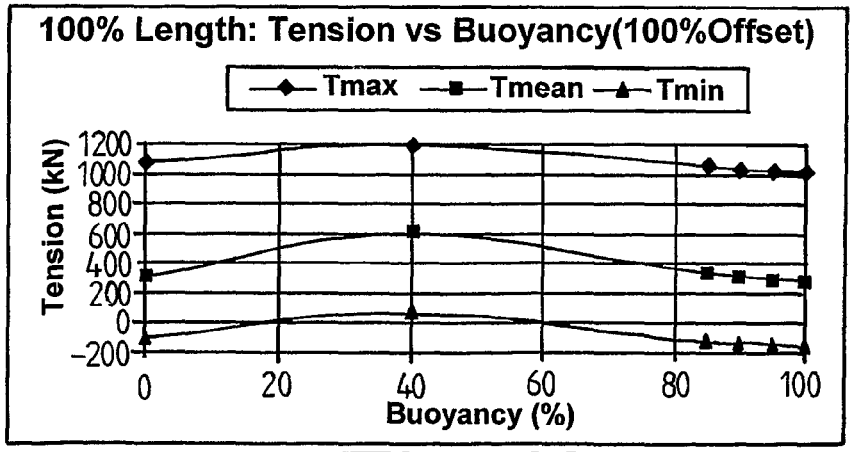

FIG. 12 is a plot of the tension variation due to buoy size variation.

Figure 13:
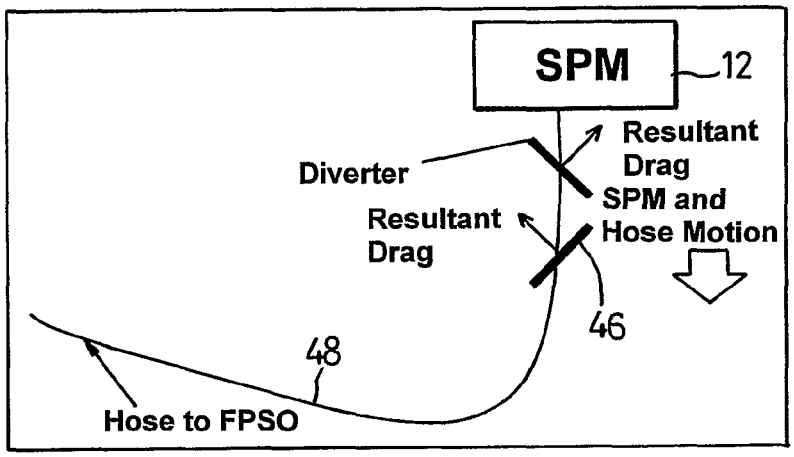

FIG. 13 is a schematic view of the arrangement including a diverter.

Figure 14:
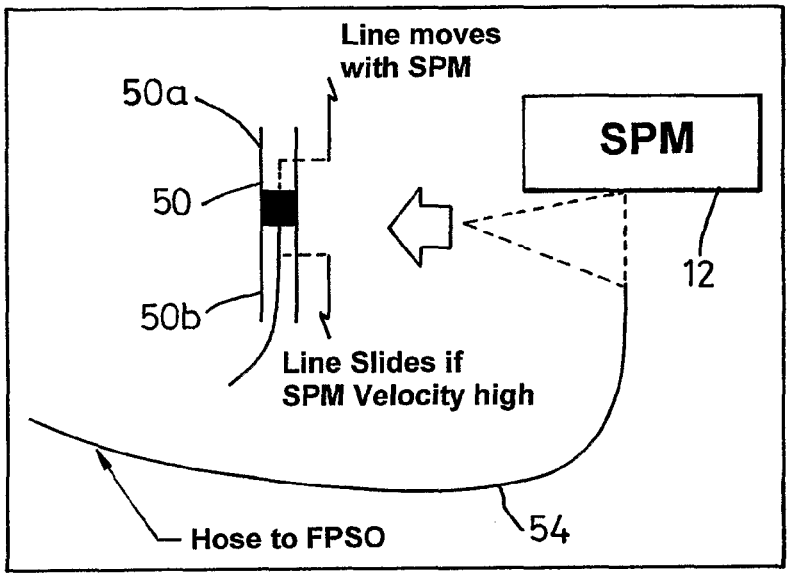

FIG. 14 is a schematic view of the sliding SPM connection.

Figure 15:
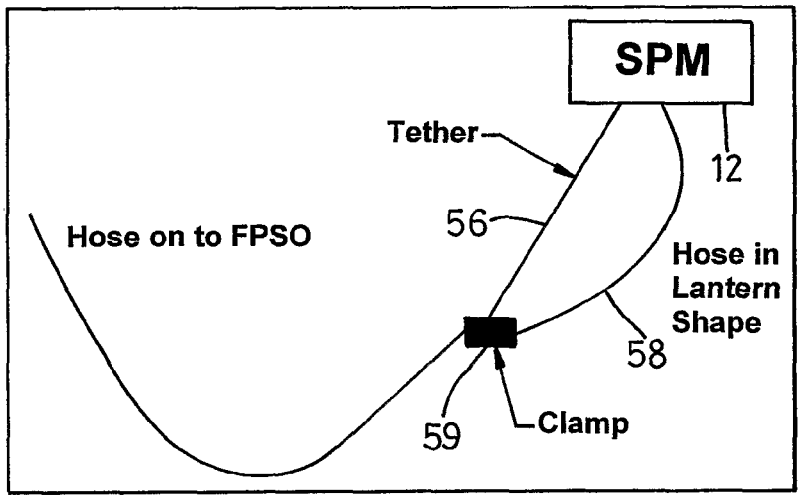

FIG. 15 shows the configuration including an isolating tether.

Figure 16:
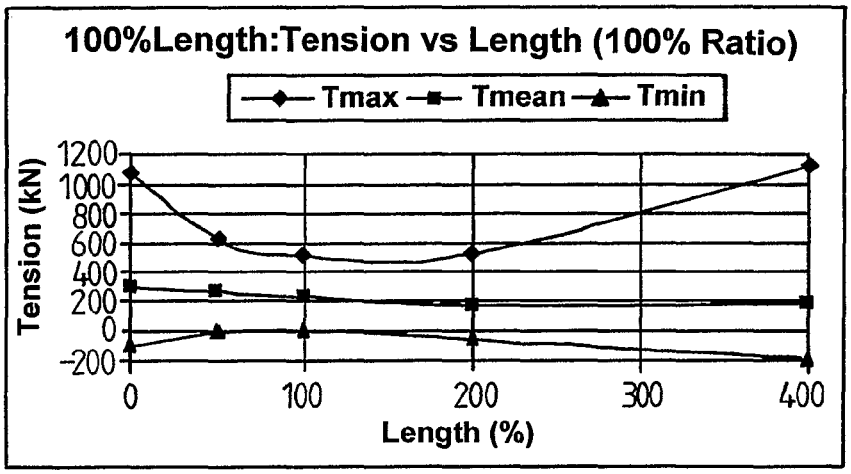

FIG. 16 is a plot of the tension variation with tether length variation.

Figure 16A:
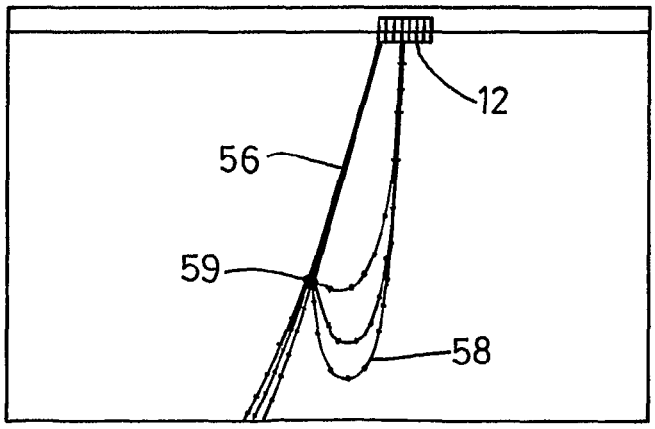

FIG. 16*a* shows a configuration with different ratios of tether to hose length.

Figure 17:
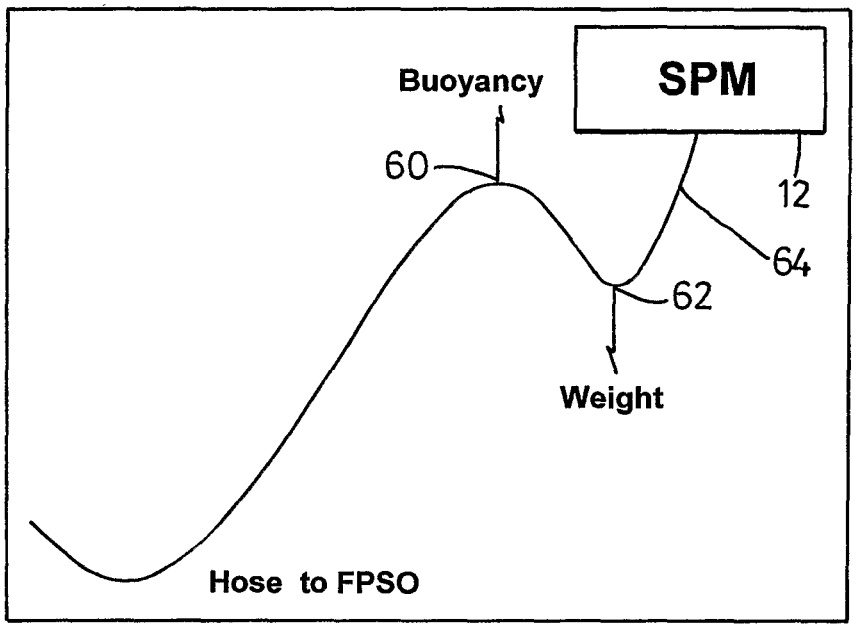

FIG. 17 is a schematic view of the configuration including a combination of buoys and weights.

Figure 18:
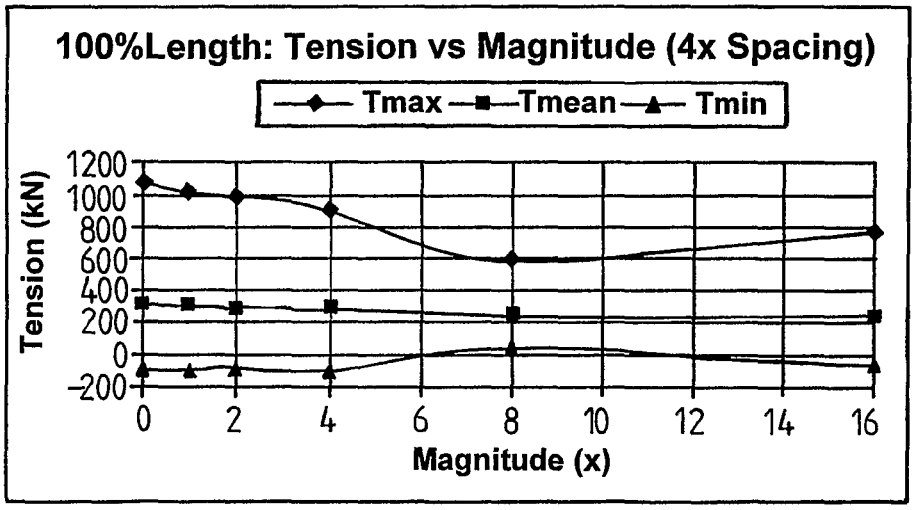

FIG. 18 is a plot of tension variation with buoy and weight magnitude variation.

Figure 1:
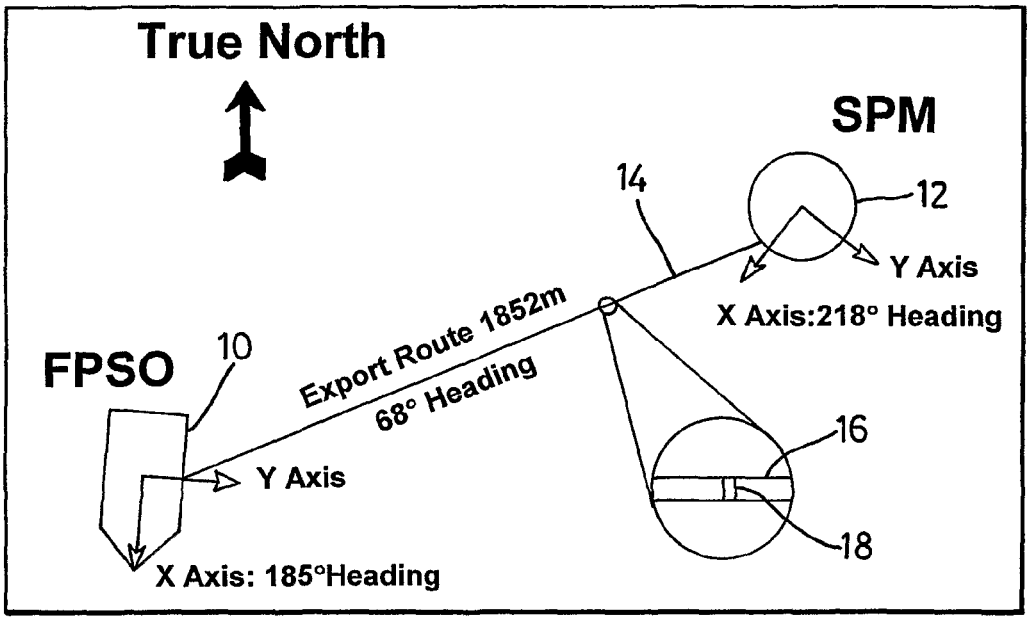
FIG. 1 is a schematic plan of the system

Referring to FIG. 1, an oil production system according to an embodiment of the invention comprises an FPSO 10 and a single point mooring buoy (SPM) 12 spaced apart by a distance of 1852 m. A single 20 inch diameter export pipe 14 connects the FPSO to the SPM. The pipe 14 is flexible and of substantially constant diameter and material, and hence flexibility, along its length. The flexible pipe 14 is made up of pipe sections 16 each of which is 10.7 m long, the sections being joined together by releasable couplings 18. The pipe sections comprise mandrel built bonded hose sections made up of elastomeric material and layers of reinforcing material that are bonded into one by heating. Each of the pipe sections can have buoyancy connected to it or can be left with no buoyancy.

Figure 2:
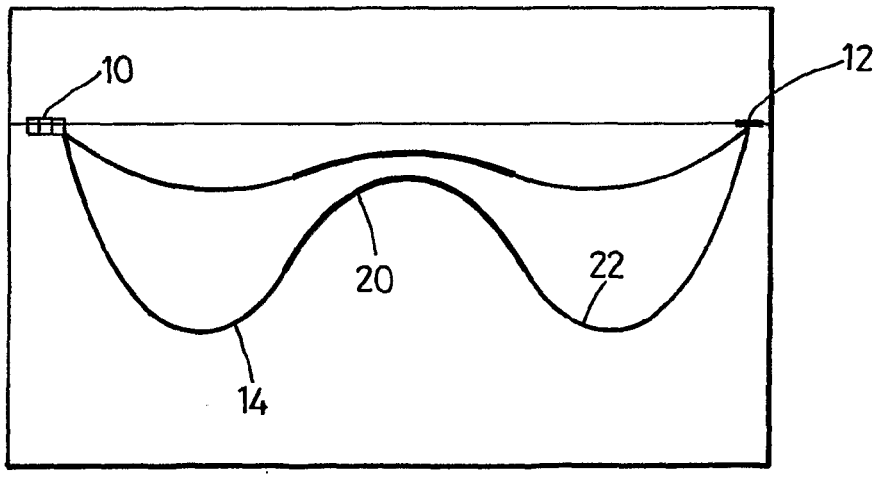
FIG. 2 shows the configuration at maximum and minimum line length.

Referring to FIG. 2, the pipe 14 is a mid-water pipe, which means that it is substantially longer than the distance between the FPSO and the SPM, so that it can sink well below the surface of the water, but not so long that it reaches the sea bed. It will be appreciated that, if no buoyancy were provided the pipe 14 would hang in a substantially U shaped curve, with its lowest point about half way between the SPM and the FPSO. However, in this embodiment a central region 20 of the pipe 14 is buoyed, with buoyancy distributed along it. This is achieved by attaching buoyancy, in this case 2 buoys, to each of the pipe sections in this central region 20. The regions 22 of the pipe 14 to either side of the central region 20 are left without buoyancy. Table 1 shows the number of pipe or hose sections in each region of the pipe 14. As can be seen, at least one reinforced section is provided at each end, and the central buoyed section in the centre comprises 71 sections with each buoyed region comprising 83 sections. This configuration will be referred to as the base configuration. It can be seen from Table 1 that, in the base case, the total length of the pipe 14 is 1.38 times the length of the distance between the FPSO and the SPM, and the central buoyed section is 29.7% of the length of the pipe 14.

TABLE 1

| Type | No. Hoses | Length |
|---|---|---|
| Reinforced | 1 | 10.7 m |
| Mainline | 83 | 888.1 m |
| With Modules | 71 | 759.7 m |
| Mainline | 83 | 888.1 m |
| Reinforced | 1 | 10.7 m |
| Total | 239 | 2557.3 |

Various modifications to this embodiment are possible. Firstly the length of the pipe 14 can be varied, with the proportion of the pipe that is buoyed remaining the same. FIG. 2 shows one variation in which the pipe length is 70% of the base configuration. Table 2 below shows the number of buoyed, unbuoyed, and reinforced sections in the base configuration, the 70% length variation, and other variations of intermediate lengths.

TABLE 2

| Type | 70% | 80% | 85% | 90% | 95% | 100% |
|---|---|---|---|---|---|---|
| Reinforced | 1 | 1 | 1 | 1 | 1 | 1 |
| Mainline | 57 | 66 | 70 | 74 | 79 | 83 |
| With Modules | 51 | 57 | 61 | 65 | 67 | 71 |
| Mainline | 57 | 66 | 70 | 74 | 79 | 83 |
| Reinforced | 1 | 1 | 1 | 1 | 1 | 1 |
| Total | 167 | 191 | 203 | 215 | 227 | 239 |

Figure 3:
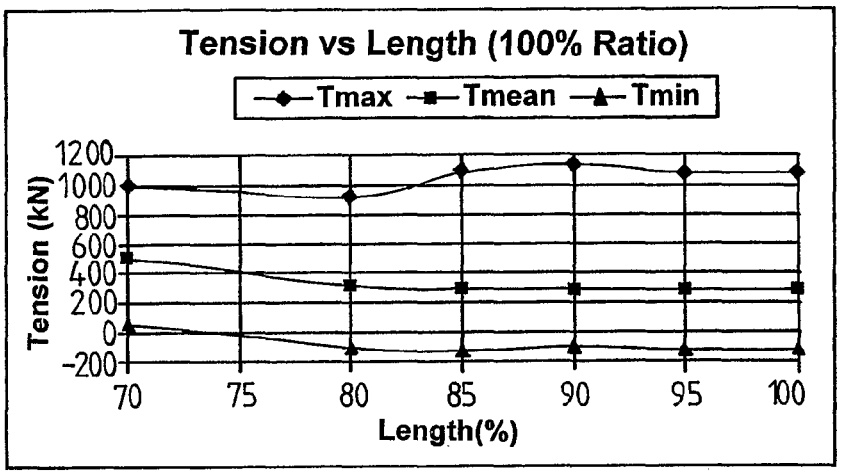
FIG. 3 is a plot of the loading experienced by different hose lengths.

Using computer simulation, each of the variations of Table 2 were analysed to determine the loads that would occur in the system of FIG. 1 under various conditions. Most of the loads are caused by vertical movement of the SPM as it floats on the uneven surface of the sea. These loads are mostly tension loads, but when the SPM is moving downwards compression loads can be produced. The maximum, minimum and mean loads are shown in FIG. 3, with tension loads being shown as positive and compression loads being shown as negative. The maximum loads are absolute maximum, and therefore include snatch loads where these occur.

As can be seen from FIG. 3, the maximum load is lowest at 80% of the base configuration length. At higher lengths the maximum loads increase, and time history analysis of the loads indicate that this is because snatch loads are occurring. For lengths of 80% of the base configuration and more, some compression loads are also seen to occur.

If a more detailed analysis of the 70%, 90% and 100% lengths are made, it can be shown that for lengths less than 80% of the base length, tension loads rise as length decreases. For the 70% length pipe there are generally no compression loads, but in some cases, particularly where the weather is towards the FPSO, and so the FPSO weathervanes away from the SPM increasing the distance between the two, the tension loads become undesirably high.

The base configuration can also be modified by modifying the length of the central buoyed region 20, while keeping the amount of buoyancy per pipe section and the total pipe length the same as in the base case. Examples are shown below in Table 3, with the buoyancy ratio for each example expressed as an approximate ratio of the length of buoyed pipe to the length in the example to the length of buoyed pipe in the base case. The numbers of pipe sections in each region are shown in Table 3.

TABLE 3

| Type | 60% | 70% | 80% | 90% | 100% | 110% |
|---|---|---|---|---|---|---|
| Reinforced | 1 | 1 | 1 | 1 | 1 | 1 |
| Mainline | 97 | 93 | 90 | 86 | 83 | 79 |
| With Modules | 43 | 51 | 57 | 65 | 71 | 79 |
| Mainline | 97 | 93 | 90 | 86 | 83 | 79 |
| Reinforced | 1 | 1 | 1 | 1 | 1 | 1 |
| Total | 239 | 239 | 239 | 239 | 239 | 239 |

Figure 4:
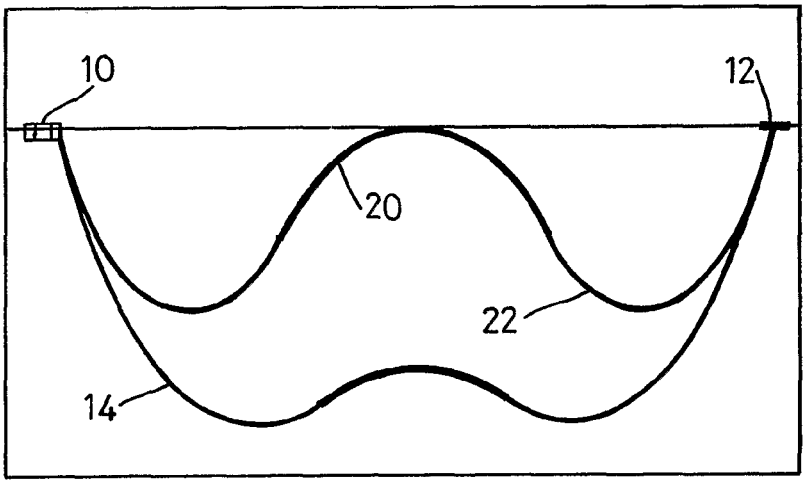
FIG. 4 shows the configuration at maximum and minimum buoyancy ratio.

Referring to FIG. 4, in the 110% buoyancy ratio example the central point 20 of the buoyed region is lifted up to the surface of the sea, whereas in the 60% buoyancy ratio example the buoyed region only rises slightly above the lowest parts of the unbuoyed regions. The other examples are not shown in FIG. 4.

Figure 5:
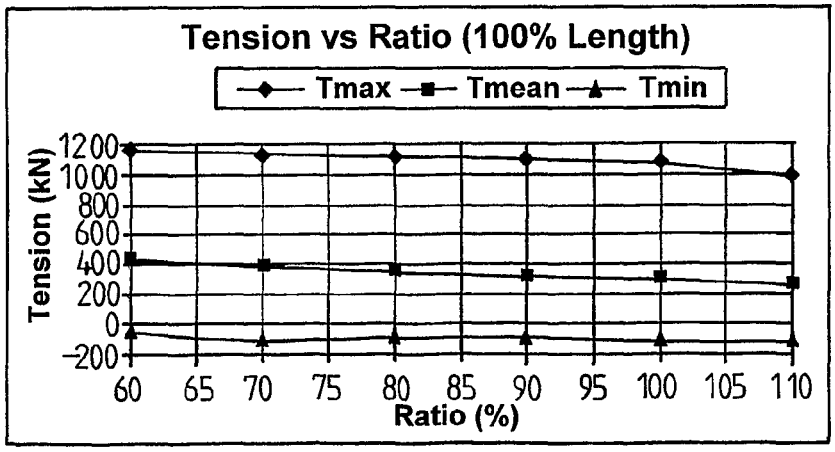
FIG. 5 is a plot of the tension variation due to buoyancy ratio variation.

Referring to FIG. 5, the loads in the examples of table 3 were again analysed and it can be seen that high maximum loads of over 1000 kN were experienced in all cases, indicating that snatch loading was occurring. However, the maximum load decreased steadily with increasing buoyancy ratio, as does the mean load. Compression loads also occur at all buoyancy ratios.

Referring to FIG. 6, in a second embodiment of the invention, a pipe 30 is made up of 10.7 m pipe sections which are the same as those of the first arrangement. However, in this case a plurality of buoyed regions 32 are provided which are spread along the length of the pipe, with unbuoyed regions between them. This causes the pipe 30 to take up an undulating form that is approximately sinusoidal. Specifically, in the embodiment shown, the pipe is 2557.3 m long, and there are three buoyed regions 32 with four unbuoyed regions between them and at the ends of the pipe 30. Table 4 below sets out the number of pipe sections in each of the buoyed and unbuoyed regions along the pipe 30.

TABLE 4

| Type | No. Hoses | Length |
|---|---|---|
| Reinforced | 1 | 10.7 m |
| Mainline | 41 | 438.7 m |
| With Modules | 33 | 353.1 m |
| Mainline | 27 | 288.9 m |
| With Modules | 35 | 374.5 m |
| Mainline | 27 | 288.9 m |
| With Modules | 33 | 353.1 m |
| Mainline | 41 | 438.7 m |
| Reinforced | 1 | 10.7 m |
| Total | 239 | 2557.3 m |

This configuration can be modified by modifying the total hose length whilst keeping the buoyed proportion of the hose constant. The numbers of pipe sections in each region of pipes of varying lengths are shown in Table 5 below. A length of 100% refers to the base case length of 2557.3 m, the minimum length being 70% of this.

TABLE 5

| Type | 70% | 80% | 85% | 90% | 95% | 100% |
|---|---|---|---|---|---|---|
| Reinforced | 1 | 1 | 1 | 1 | 1 | 1 |
| Mainline | 29 | 33 | 35 | 37 | 39 | 41 |
| With Modules | 21 | 25 | 27 | 29 | 31 | 33 |
| Mainline | 21 | 23 | 24 | 25 | 26 | 27 |
| With Modules | 23 | 27 | 29 | 31 | 33 | 35 |
| Mainline | 21 | 23 | 24 | 25 | 26 | 27 |
| With Modules | 21 | 25 | 27 | 29 | 31 | 33 |
| Mainline | 29 | 33 | 35 | 37 | 39 | 41 |
| Reinforced | 1 | 1 | 1 | 1 | 1 | 1 |
| Total | 167 | 191 | 203 | 215 | 227 | 239 |

Figure 7:
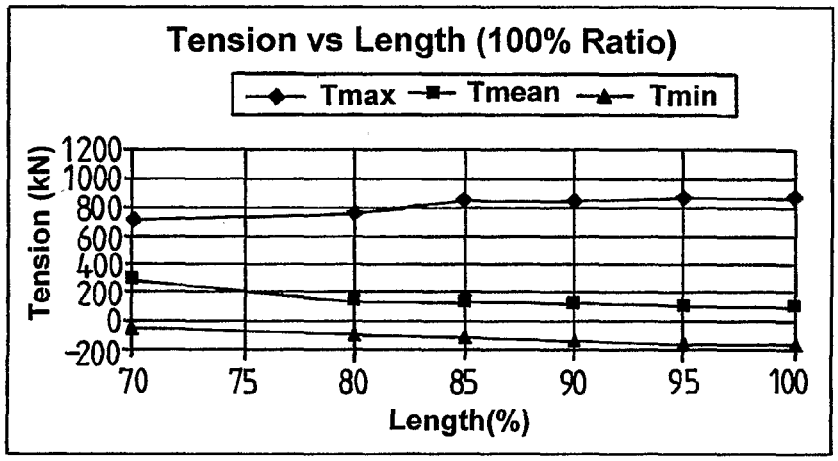
FIG. 7 is a plot of the tension variation due to length variation of the configuration of FIG. 6.

Referring to FIG. 7, the variation in tension experienced by hoses of different lengths was analysed. It can be seen that increasing amounts of compression occur as the hose length increases. The mean tension does not respond to variation in hose length above a length of 80%, increasing slightly only when the length is less than 80%. The values of the maximum tension show the opposite trend, increasing as the hose length increases. This is due to snatch loading occurring in each case.

This embodiment can be modified further by varying the proportion of buoyancy whilst keeping the total length at 100% of the base case. Table 6a below shows the number of pipe sections in each region of the hose that are buoyed, with the percentages in the first line indicating buoyancy ratios, which in each case is the ratio of the number of buoyed sections to the corresponding number in the base case.

TABLE 6a

| Type | 60% | 70% | 80% | 90% | 100% | 110% |
|---|---|---|---|---|---|---|
| Reinforced | 1 | 1 | 1 | 1 | 1 | 1 |
| Mainline | 49 | 47 | 45 | 43 | 41 | 39 |
| With Modules | 17 | 21 | 25 | 29 | 33 | 37 |
| Mainline | 43 | 39 | 35 | 31 | 27 | 23 |
| With Modules | 19 | 23 | 27 | 31 | 35 | 39 |
| Mainline | 43 | 39 | 35 | 31 | 27 | 23 |
| With Modules | 17 | 21 | 25 | 29 | 33 | 37 |
| Mainline | 49 | 47 | 45 | 43 | 41 | 39 |
| Reinforced | 1 | 1 | 1 | 1 | 1 | 1 |
| Total | 239 | 239 | 239 | 239 | 239 | 239 |

Referring to FIG. 8*a*, as with the base configuration, in the 110% buoyancy ratio example the central point 34 of each buoyed region 32 is lifted up to the surface of the sea, whereas in the 60% buoyancy ratio example the buoyed regions only rise slightly above the adjacent unbuoyed regions.

Referring to FIG. 8*b*, it can be seen that the mean tension reduces with increased buoyancy up to a buoyancy ratio of about 100% and then levels off. The maximum tension curve does not follow this trend, showing high maximum loading that indicates snatch loading. Compression loads also occur at all buoyancy ratios.

Further analysis was also carried out on the 100% buoyancy case with a hose length of 90% of the base case length. Table 6b below gives the number of hose sections in each region of the pipe for lengths of both 100% and 90% of the base case length.

TABLE 6b

| Type | 90% | 100% |
|---|---|---|
| Reinforced | 1 | 1 |
| Mainline | 37 | 41 |
| With Modules | 29 | 33 |
| Mainline | 25 | 27 |
| With Modules | 31 | 35 |
| Mainline | 25 | 27 |
| With Modules | 29 | 33 |
| Mainline | 37 | 41 |
| Reinforced | 1 | 1 |
| Total | 215 | 239 |

This analysis showed an improvement in the maximum tension. However, compression still occurs in both the 100% and 90% hose lengths and snatch loading is still observed.

In general it is shown that increasing the buoyancy decreases the mean tension but appears to make snatch loading more severe. This configuration with a plurality of buoyed regions also appears to be more prone to compression and snatch loading than the base configuration.

Referring to FIG. 9, in a third embodiment of the invention, a hose 40 is made up of 10.7 m hose sections which are the same as those in the original arrangement. However, in this case the distributed buoyancy along the hose regions is replaced with large buoys 42. In the base case of this configuration the hose is sized to give the same 100% length as for the base case of the W configuration. The arrangement can be modified to give a hose length of 90% of the base case hose length by shortening the hose length evenly across the configuration.

The base buoy has a mass of 42 te, a volume of 105 $m^3$, a net buoyancy of 65.6 te and a drag area of 20 $m^2$.

Table 7 below shows the number of hose sections in each region of the hose for lengths of 100% and 90% of the base case length.

TABLE 7

| | 100% | | 90% | |
|---|---|---|---|---|
| Length | Length | No. | Length | No. |
| SPM to 1st Buoy | 856 m | 80 | 770.4 m | 72 |
| 1st Buoy to 2nd Buoy | 845.3 m | 79 | 759.7 m | 71 |
| 2nd Buoy to FPSO | 856 m | 80 | 770.4 m | 72 |
| Total | 2557.3 m | 239 | 2300.5 m | 215 |

Referring to FIG. 10, the third embodiment can be modified further by varying the position of the buoy 42 along the hose 40. The region of interest is the SPM 12 end of the hose and therefore only the position of the buoy at this end is varied. Table 8 below shows examples of the variation in the offset along the hose from the SPM connection for hose lengths of 100% and 90% of the base case length.

TABLE 8

| | 100% | | 90% | |
|---|---|---|---|---|
| Offset | Length | No. Hoses | Length | No. Hoses |
| 120% | 1027.2 m | 97 | 920.2 m | 86 |
| 100% | 856.0 m | 80 | 770.4 m | 72 |
| 80% | 684.8 m | 64 | 620.6 m | 58 |
| 60% | 513.6 m | 48 | 470.8 m | 44 |
| 30% | 256.8 m | 24 | 235.4 m | 22 |

The loads in the examples in Table 8 were analysed and the results of this analysis on the 100% length example can be seen in FIG. 11. The mean tension curve indicates that tension reduces over a limited offset range of between about 30% and 100% offset. However, the minimum loading remains in compression and the maximum loading remains high indicating snatch loading throughout.

Referring to FIG. 11*a*, analysis on the 90% length example showed a similar trend in the mean tension. It reduces over an offset range of between about 30% and 100%, rising slightly above 100% offset. The minimum loading remains in compression and, although the maximum tension is lower than that in the 100% length example, the maximum tension remains high.

Further modifications can be made by varying the size of the buoy and therefore the buoyancy. Examples of buoy size variations in cases considered are shown in Table 9 below.

TABLE 9

| Size | Mass | Volume | Net Buoyancy | Drag Area |
|---|---|---|---|---|
| 100% | 42.0 te | 105.0 $m^3$ | 65.6 te | 20.0 $m^2$ |
| 95% | 39.9 te | 99.8 $m^3$ | 62.3 te | 19.3 $m^2$ |
| 90% | 37.8 te | 94.5 $m^3$ | 59.1 te | 18.6 $m^2$ |
| 85% | 35.7 te | 89.3 $m^3$ | 55.8 te | 17.9 $m^2$ |
| 40% | 16.8 te | 42.0 $m^3$ | 26.3 te | 10.9 $m^2$ |

Referring to FIG. 12, it can be seen from analysis of the loads experienced in the example of 100% length that there are snatch loads for all except the 40% buoyancy case. The minimum tension curve shows that the buoyancy needs to be between 20% and 60% of the base case to avoid compression. However, at these levels of buoyancy the tension is too high. In general, this arrangement gives improved compression prevention. However, it does not overcome the problem of high tension. Reducing the tension requires greater buoyancy that results in higher compression and snatch loads.

Since this configuration results in the buoyancy being applied at two points on the hose, bend protection will be required in these regions of the hose.

As described above, the shaping of the hose can be used to reduce the tension and compression loads in the hose. However, it is desirable to provide further decoupling of the movement of the SPM from the main part of the hose.

Referring to FIG. 13, a first decoupling arrangement, diverters 46 are attached to the hose 48 to control the location of the hose bend. Generally, the main body of the suspended hose remains straight until the compressive load is sufficient to force it to bend. This can result in over-bending or fatigue. The rapid heave of the SPM connection causes the hose to be driven downwards rapidly, resulting in high compressions. The diverters are circular disks attached to the hose couplings and are angled relative to the hose central axes. In this case two diverters 46 are provided. They are spaced apart from each other along the hose 48 and are angled in opposite directions. Any axial motion of the hose therefore generates out-of-plane drag loads via the diverters, causing the hose to bend closer to the SPM 12 connection, thus decoupling the main part of the hose from the movement of the SPM.

Rapid movement of the SPM can cause high compression or tension in the hose. To overcome this problem, referring to FIG. 14, a further decoupling arrangement includes a modification to the SPM connection in the form of a sliding SPM connection 50 formed from two halves 50*a*, 50*b*, one of which is connected to the SPM, either directly or via a short length of hose, and the other of which is connected to the main length of hose 54. The two halves 50*a*, 50*b* are slidably coupled together, and can move over a stroke length of 5 m relative to each other.

Figure 14A:
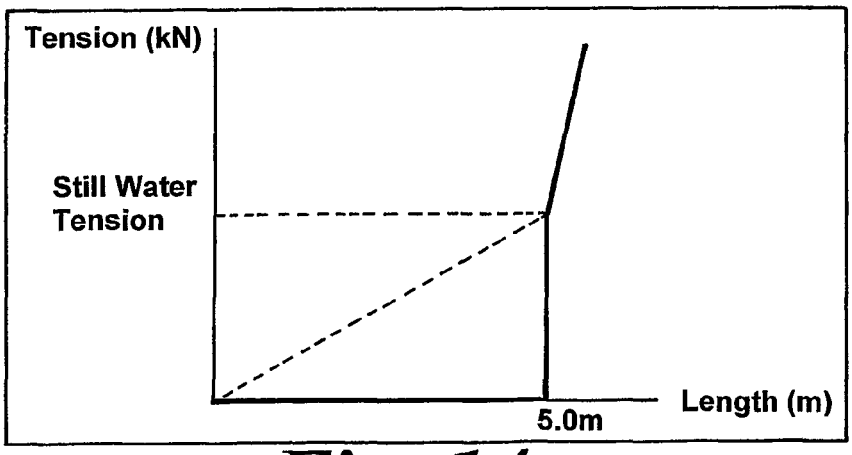

Referring to FIG. 14*a*, the length of the connector is arranged to vary with the tension in the hose 54. Under static still water conditions the hose is under a constant level of tension. As illustrated in the solid line of FIG. 14*a*, if the tension increases above that level the connector is arranged to expand slightly. If the tension falls below the still water tension the connector length remains constant until the tension reduces to zero. At that point, as soon as the connector experiences a compression force it is arranged to contract in length. The result of this is that a rapid downward movement of the SPM from its still water position causes the sliding connection to slide, de-coupling the critical main part of the hose and the SPM motions. When modelling a sudden upward movement of the SPM from its still water position, the coupling extends slightly since the two halves 50*a*, 50*b* of the connector cannot be held rigidly in position. In practice, however, an upward movement of the SPM may cause no extension at all.

The dotted line in FIG. 14*a* shows a modification to the sliding connector in which the contraction of the connector varies continuously in a linear manner as the tension falls below the still water tension level. Again, the connector reaches its minimum length when the tension falls to zero. Both versions of the sliding connector therefore reduce the compressive effect of downward movements of the SPM.

Compression also occurs at points on the hose further away from the SPM connection. Other types of sliders may be provided at these points on the hose instead of at the SPM connection.

A further decoupling arrangement is shown in FIG. 15. Compression problems are generally experienced in the suspended length 58 of hose below the SPM 12. An isolating tether 56 is therefore used to isolate the majority of the suspended flexible hose from the SPM by being attached at a point part way down the flexible hose. The length of the tether 58 between the SPM and the tether clamp 59 is less than the length of hose from the SPM to the tethered point. The tether is made from a slightly resilient, elastic or stretchy material, thereby reducing the rate and amplitude of the SPM motions as it stretches. The length of hose between the SPM and the end of the isolating tether is encouraged to bend, reducing the chances of high compression being generated. The base case for this configuration consists of a tether of length 90 m attached to the hose with a clamp thirteen hose lengths (139.1 m) from the SPM connection.

The arrangement can be modified by varying the rope material used for the tether. Analysis of the base case with each of four different tether types was carried out. The properties of the four tether types can be seen in Table 10 below.

TABLE 10

| Line Type | Nominal OD (mm) | Mass (kg/m) | EA (kN) | Tbreak (kN) |
|---|---|---|---|---|
| Wire (Fibre core) | 53 | 10.0 | 103,090 | 1,640 |
| Polypropylene | 125 | 7.1 | 16,562 | 1,656 |
| Polyester | 99 | 7.8 | 10,683 | 1,671 |
| Nylon | 110 | 7.8 | 1,728 | 1,686 |

Nylon was found to show significant improvement in the maximum and minimum tensions. The compression is almost negligible and the maximum tension is below the limit of 687 kN, significantly lower than the other tether types. This is therefore the most suitable material for use as an isolating tether.

Further modifications can be made by varying the tether length 56, moving the position of the clamp 59 to keep the length ratio of tether to parallel hose constant. Examples of possible tether lengths are shown in Table 11 below.

TABLE 11

| | | Clamp from SPM Connection | |
|---|---|---|---|
| Factor | Tether Length | Length | No. Hoses |
| 50% | 45 m | 74.9 m | 7 |
| 100% | 90 m | 139.1 m | 13 |
| 200% | 180 m | 278.2 m | 26 |
| 400% | 360 m | 556.4 m | 52 |

Referring to FIG. 16, a tension plot for a hose of base case length, optimum tether lengths are clearly seen. For tether lengths of between 50% and 200% of the base case the tension range is small. This indicates that there is no snatch loading and provides more acceptable tension values.

Referring to FIG. 16*a*, in a further modification to the base case, the suspended hose length 58 is varied whilst keeping the tether length constant, therefore varying the ratio of tether to parallel hose. The options considered are shown in Table 12 below.

TABLE 12

| Factor | Clamp Position On Hose | Ratio |
|---|---|---|
| 100% | 139.1 m | 1.6 |
| 125% | 181.9 m | 2.0 |
| 150% | 214.0 m | 2.4 |

Analysis of these options shows that reduction in the length ratio results in a greater chance of snatch loading and increased tension range. This is to be expected since reducing the ratio results in a system similar to the original "W"-shaped system.

The analysis shows that the optimum tether length is from 50% to 200% with a ratio at 100% or more. Significant improvements in tension and compression are seen, especially as snatch loading is removed.

Bend protection may be required with this embodiment, in particular at the tether clamp 59.

In a further decoupling arrangement, the isolating tether 56 is replaced with buoyancy means 60 and weights 62. Referring to FIG. 17, the weight 62 is positioned between the buoy 60 and the SPM 12 so that portion of the hose 64 close to the SPM remains bent, limiting compression and reducing the affect of the SPM motion. The buoy used in the base case typically has a mass of 6.9 te, a volume of 11.6 $m^3$, a submerged weight of −5.0 te and a drag area of 5.12 $m^2$. The weight used in the base case typically has a mass of 2.78 te, a volume of 0.37 $m^3$, a submerged weight of 2.4 te and a drag area of 0.8 $m^2$. In the base case the weight is attached at a distance of about 0.84% (2 hose lengths) of the total hose length from the SPM and the buoy is at a distance of about 1.67% (4 hose lengths) of the total hose length from the SPM.

The arrangement can be modified by varying the position of the buoy 60 and weight 62 along the hose. The spacing of the SPM connection to weight and weight to buoy is kept equidistant. Analysis of the mean tension for different spacing shows that there is a slight increase in tension with reduced spacing. Snatch loading can also be seen in each case.

Further modifications include varying the magnitude of the weight 62 and buoy 60. Analysis was carried out using weights and buoys of 1 times, 2 times, 4 times, 8 times and 16 times the base case size. Referring to FIG. 18, it can be seen that snatch loading will occur for weights of 4 times the base case size or smaller. Snatch loading also reoccurs at 16 times the base case size. A size of 8 times the base case size is the best option since it avoids snatch loading and gives much improved tension. Analysis carried out using a weight and buoy configuration of 8 times the base case size and a spacing of 8 times showed that hose lengths of 100% and 90% of the base case length both gave a maximum tension below the limit of 687 kN.

It can be seen from the embodiments described that the isolating tether and weight/buoy systems are both effective solutions to overcome the local effects of the SPM motions. The wave configuration and the lumped buoy configuration are also effective systems for reducing the snatch loading and can be used in conjunction with either of the embodiments.

The embodiments of the invention described above may also be applied to configurations using a 30-inch hose, or other hose dimensions. They are also applicable to other types of hose, such as non-bonded hose, and also metal pipes. Even though metal pipes are more rigid they still suffer from fatigue caused by tension and compression and the methods described above for reducing tension and compression loads work also in metal pipes.

The invention claimed is:

1. An apparatus for transferring oil between a first facility and a second facility, the apparatus comprising:

a floating buoy;

a pipe supported at a first end by the floating buoy, and having a central axis;

a drag plate provided on the pipe at an oblique angle to the central axis, for generating an out-of-plane load on the pipe; and a second drag plate provided on the pipe at an oblique angle to the central axis, the drag plate and the further drag plate being at opposite angles relative to the central axis.

2. The apparatus as claimed in claim 1, in which the drag plate comprises a circular drag plate and/or the further drag plate comprises a circular drag plate.

3. An apparatus for transferring oil between a first facility and a second facility, comprising:

a floating buoy;

a pipe supported at one end by the floating buoy, the pipe comprising at least a first length and a second length; and a sliding joint comprising a first half and a second half moveably connected together, the first half being connected to the first length of the pipe and the second half being connected to the second length of the pipe, whereby a downward movement of the floating buoy causes the two halves of the sliding joint to slide in relation to each other and an upward movement of the floating buoy causes the two halves of the sliding joint to lock in relation to each other.

* * * * *

UNITED STATES PATENT AND TRADEMARK OFFICE

CERTIFICATE OF CORRECTION

PATENT NO. : 8,641,324 B2
APPLICATION NO. : 11/579983
DATED : February 4, 2014
INVENTOR(S) : John Quash, Paul Lawrence and Ali Reza Kambiez Zandiyeh It is certified that error appears in the above-identified patent and that said Letters Patent is hereby corrected as shown below:

On the Title Page

Column 1, Item (75) delete "Ali Reza Kambiez Zandiyel" and insert --Ali Reza Kambiez Zandiyeh--

Signed and Sealed this
Eighth Day of July, 2014

Michelle K. Lee

Michelle K. Lee
*Deputy Director of the United States Patent and Trademark Office*